US005123549A

United States Patent [19]

Finses et al.

[11] Patent Number: 5,123,549

[45] Date of Patent: Jun. 23, 1992

[54] PAPER MANAGEMENT APPARATUS

[75] Inventors: Greg R. Finses, Green Bay; David R. Funk, De Pere, both of Wis.

[73] Assignee: Krueger International Inc., Green Bay, Wis.

[21] Appl. No.: 591,079

[22] Filed: Oct. 1, 1990

[51] Int. Cl.[5] ..... A47F 5/00

[52] U.S. Cl. ..... 211/88; 211/94; 211/103

[58] Field of Search ..... 211/94, 103, 126, 88, 211/55, 11, 194, 50

[56] References Cited

U.S. PATENT DOCUMENTS

| | | | |
|---|---|---|---|
| 3,712,698 | 1/1973 | Propst et al. . | |
| 3,759,297 | 9/1973 | Anderson et al. . | |
| 3,791,528 | 2/1974 | Brendgord | 211/88 |
| 3,908,831 | 9/1975 | Brendgord | 211/88 |
| 3,971,475 | 7/1976 | Hodges | 211/55 X |
| 4,062,452 | 12/1977 | Bartholomew | 211/55 |
| 4,224,769 | 9/1980 | Ball et al. . | |
| 4,349,113 | 9/1982 | Schreiner | 211/103 |
| 4,401,222 | 8/1983 | Kulikowski et al. | 211/94 |

OTHER PUBLICATIONS

McSort brochure from Smith Metal Arts-McDonald Products 1987.

*Primary Examiner*—Robert W. Gibson, Jr.
*Attorney, Agent, or Firm*—Fuller, Ryan, Hohenfeldt & Kees

[57] ABSTRACT

Paper management apparatus including a work bar mounted to an upright panel. The work bar has a front wall that defines a half moon shaped groove. A mounting clip has a band with a convex surface that nests within the work bar half moon groove. The mounting clip further has a hem that extends out of the work bar half moon groove. The mounting clip hem is inserted into the hem of one of a number of interchangeable paper holding accessories such as slanted storage trays, binder bins, and stackable letter trays. The letter trays and binder bins are made of side walls that assemble to respective opposed ends of trays. The letter trays have respective upper edges that define tabs with a predetermined contour and respective lower edges that define hooks with the predetermined contour. The trays are stacked by sliding the tabs of the first letter tray into the hooks of the second letter tray. The slanted storage tray has a back and a bottom formed with V-shaped pockets. A divider is removably engaged in each pocket. Suspension of a paper holding accessory in the work bar requires simultaneously tilting and inserting the mounting clip into the half moon groove, thereby preventing accidental dislodgement of the accessory from the work bar.

32 Claims, 4 Drawing Sheets

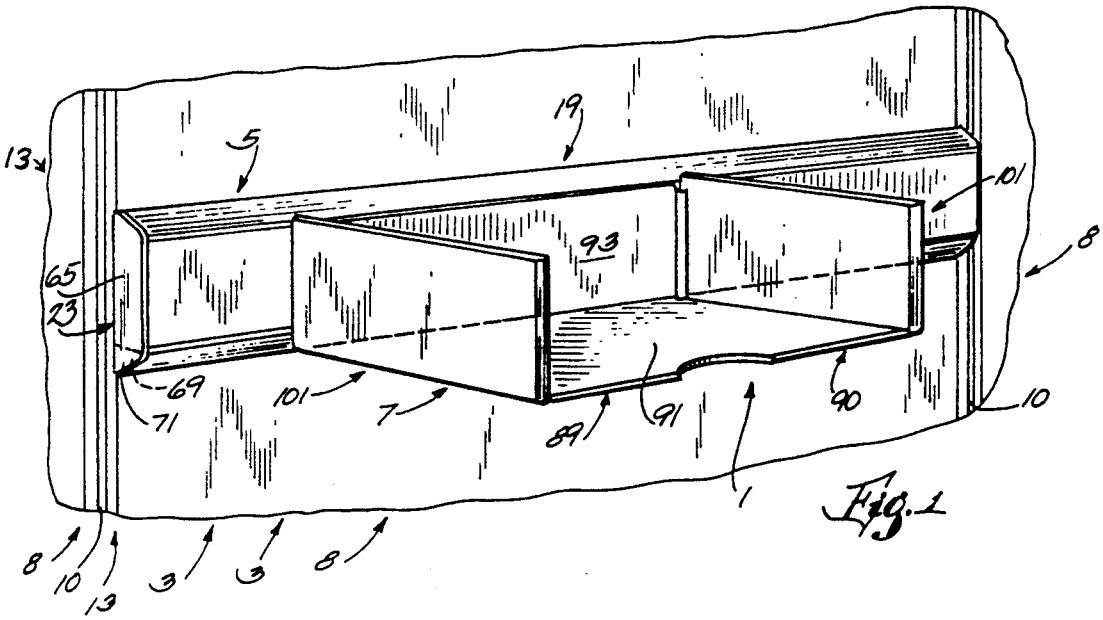
Fig. 1
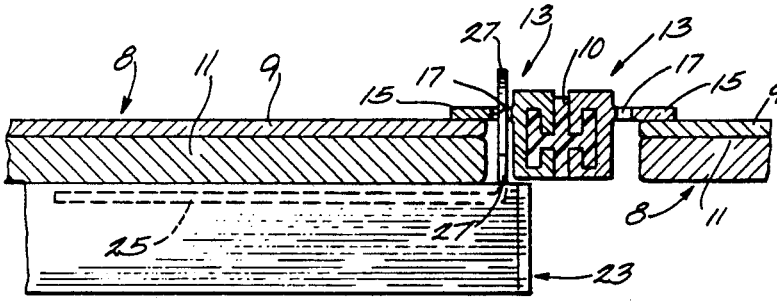
Fig. 4
Fig. 2
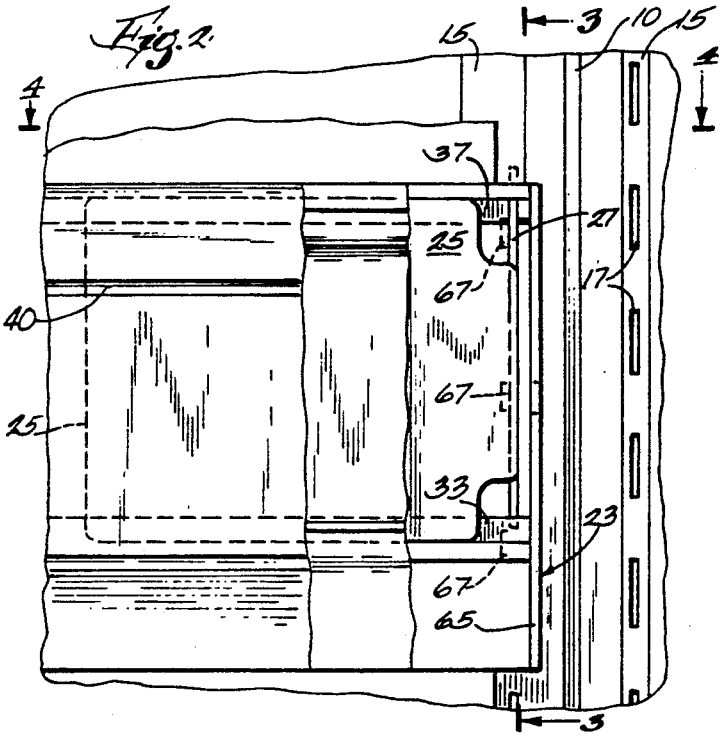
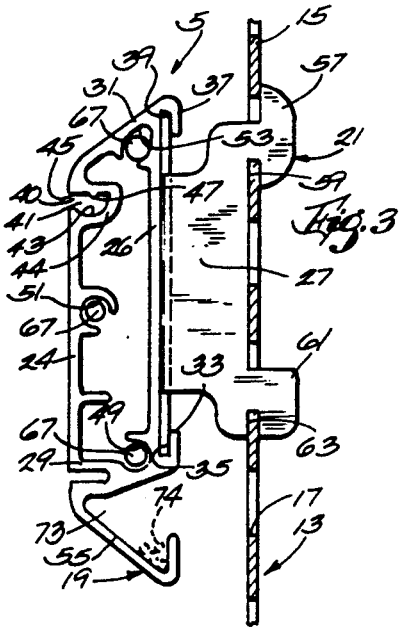
Fig. 3

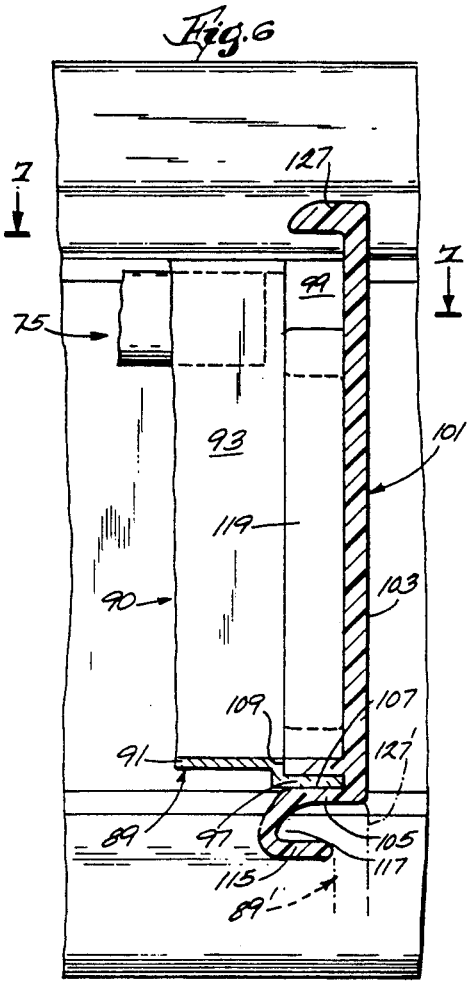
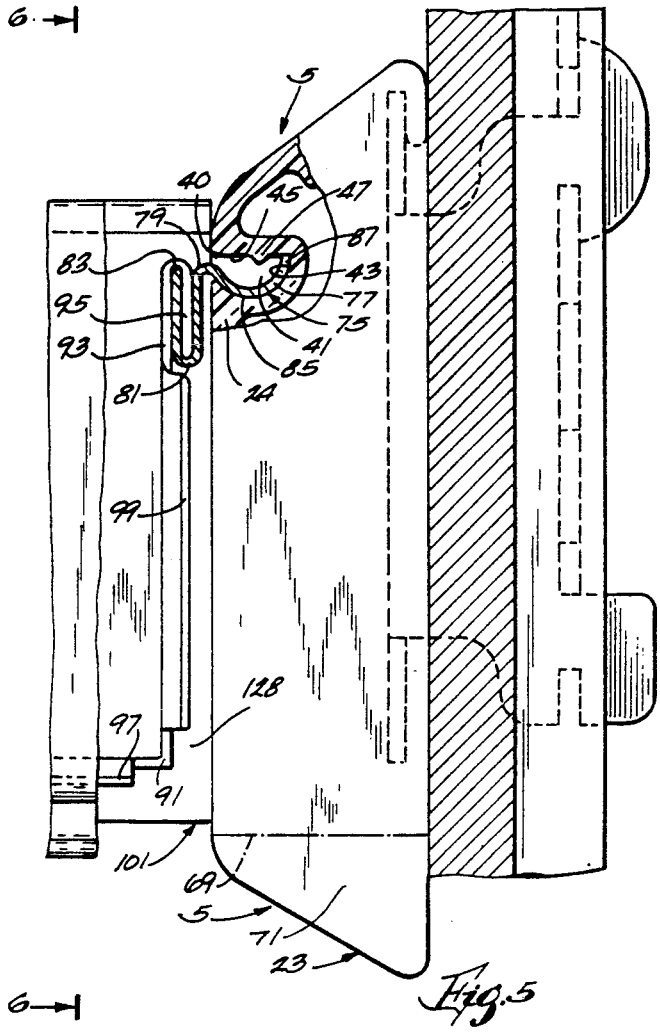
Fig.5
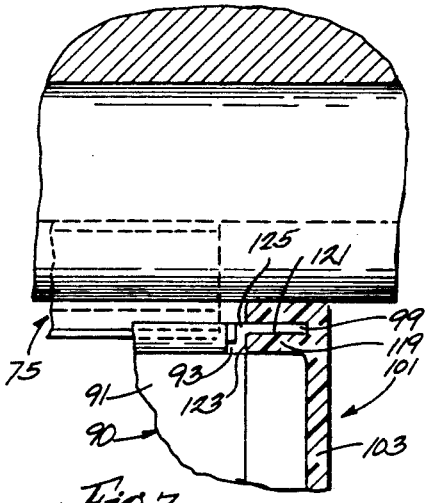
Fig.7

PAPER MANAGEMENT APPARATUS

BACKGROUND OF THE INVENTION

This invention relates to supports for papers and other office items, and more particularly to such supports which are interchangeable and adaptable to different support systems.

It is well known to arrange offices using modular workstations. The modular components are attractive, economical, and readily adaptable to changing needs of the work place. Such components include interconnecting vertical panels, work tables, cabinets, and electrical raceways.

To improve the productivity of persons using modular workstations, it is also known to incorporate paper management accessories for holding reports, books, and similar items in convenient places in the workstation. Generally speaking, the prior paper management accessories utilize one or more brackets that removably mount to a vertical panel frame. An example of a prior paper management system may be seen in Probst et al., U.S. Pat. No. 3,712,698, in which a drawer support system is hung from a rail secured to a vertical panel. Other modular accessories for receiving various papers are marketed under the trademarks "Eldonwal" and "McSort" Anderson et al., U.S. Pat. No. 3,759,297, discloses somewhat similar equipment applied to a utility line holder supported on a vertical panel.

This invention relates to improvements to some of the devices described above and to solutions to the problems raised or not solved thereby.

SUMMARY OF THE INVENTION

The paper management apparatus provided by the present invention permits organizing office papers and other materials in a more economical and versatile manner than was previously possible. This is accomplished by apparatus that includes modular bins, trays, and other components that are removably suspendable from a sturdy work bar.

In this apparatus, the work bar is mounted by means of mounting brackets to slotted vertical support members of a wall panel system. The work bar is designed to accept and conceal the mounting brackets, thereby preserving the attractiveness of the workstation. Teeth on the mounting brackets engage corresponding slots in the panel system frame such that the work bar is held sturdily in place. The work bar accepts a number of different paper management accessories. For that purpose, an exposed face of the work bar is formed with a groove having a half moon cross-section. The upper surface of the groove is flat and horizontal. A short lip depends from the groove flat surface. The lower surface of the groove is concave. The work bar half moon groove is designed to accept a convex band of a mounting clip. An upwardly open U-shaped hem connects with the mounting clip band through a reverse bend. The mounting clip hem is insertable into a similar hem located near the top of a back wall of each of the various paper management accessories to be suspended from the work bar. With the mounting clip hem inserted into the desired accessory, the accessory is tilted to enable the mounting clip band to enter the half moon groove in the work bar. The accessory is then tilted to its normal attitude while simultaneously pushing it slightly toward the work bar such that the mounting clip band properly enters the groove. The lip on the groove flat surface assures proper retention of the mounting clip within the groove. With the mounting clip properly within the work bar groove, the mounting clip band nests on the work bar groove lower surface, and the bottom portion of the accessory back wall rests against the lower portion of the work bar.

Several different types of paper management accessories can be used with the work bar and mounting clip of the present invention. The accessories include letter and legal size trays, binder bins, and slanted storage trays. The letter and legal trays are designed to be stackable, with any tray of a stack being suspendable from the work bar.

Other objects and advantages of the invention will become apparent hereinafter.

DESCRIPTION OF THE DRAWING

FIG. 1 is a perspective view of a typical installation of paper management apparatus constructed according to a preferred embodiment of the present invention.

FIG. 2 is an enlarged and partially broken front view of a of the paper management apparatus of the present invention showing the connection between the system and a wall panel.

FIG. 3 is a cross-sectional view of the apparatus shown in FIG. 2 taken along line 3—3.

FIG. 2 is a cross-sectional view of the apparatus shown in FIG. 2 taken along line 3—3.

FIG. 5 is a cross-sectional view of the apparatus view of the paper management apparatus according to the present invention showing the suspension of an accessory on the support system.

FIG. 6 is a cross-sectional view of the apparatus shown in FIG. 5 taken along line 6—6.

FIG. 7 is a cross-sectional view of the apparatus shown in FIG. 6 taken along line 7—7.

DESCRIPTION OF THE PREFERRED EMBODIMENT

Figure 8:
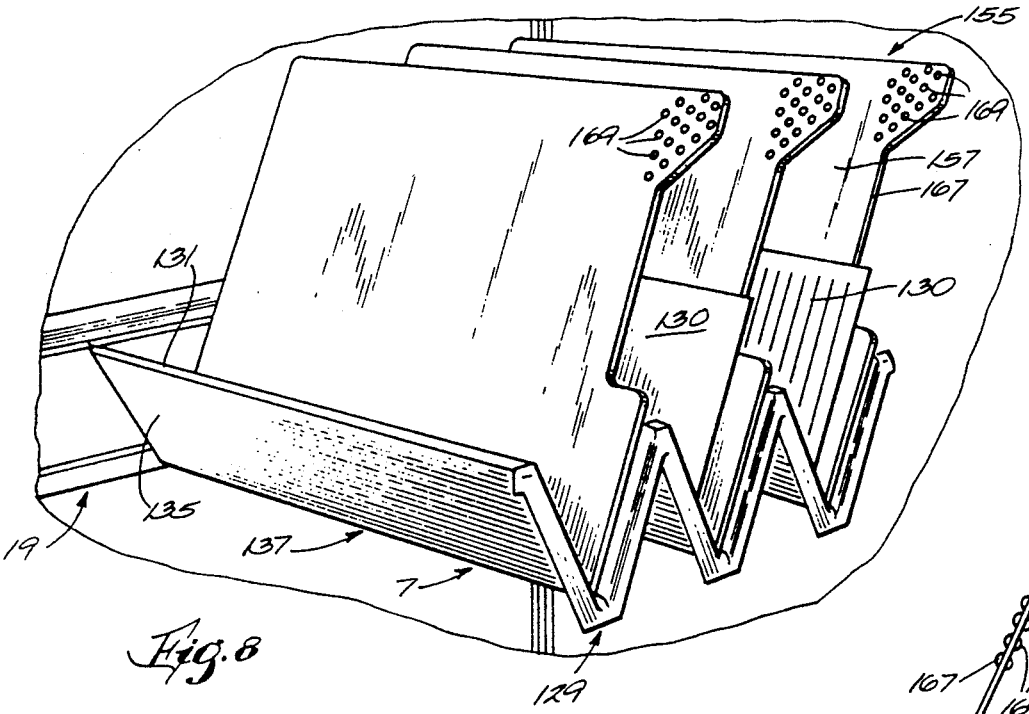
FIG. 8 is a perspective view of a different accessory suspended from the support system of the present invention.
Figure 9:
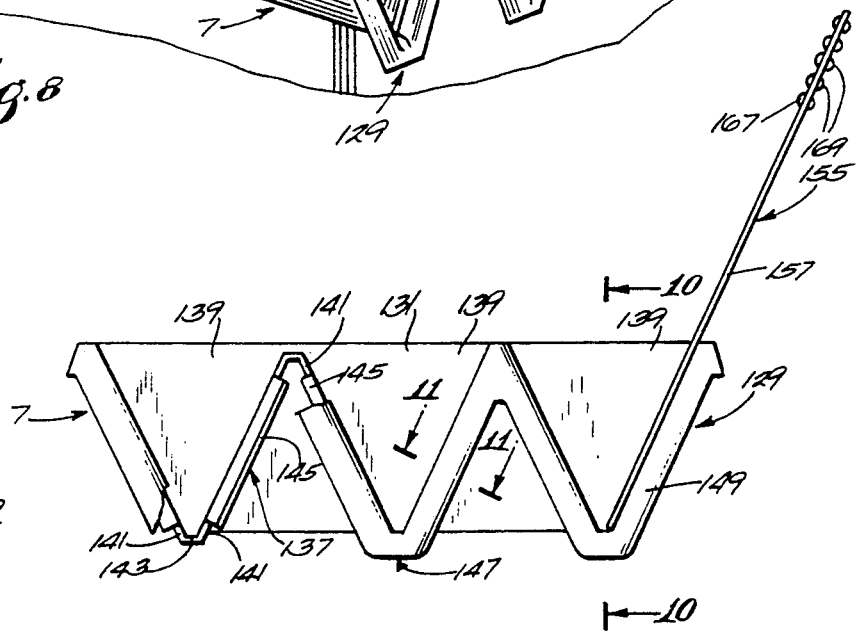
FIG. 9 a partially broken front view of the accessory or FIG. 8.
Figure 11:
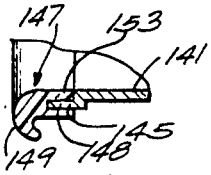
FIG. 11 is a cross-sectional view of the accessory shown in FIG. 9 taken along line 11—11.

Although the disclosure hereof is detailed and exact to enable those skilled in the art to practice the invention, the physical embodiments herein disclosed merely exemplify the invention which may be embodied in other specific structure. The true scope of the invention is defined only in the claims appended hereto. For instance while the paper management apparatus is shown in conjunction with an office panel system, it will be understood that the invention is not limited to modular work place applications.

General

Referring to FIG. 1, a paper management apparatus 1 constructed according to the present invention includes a support system 5 mounted to the panel system 3. One or more paper holding accessories 7 are removably suspended from the support system 5. The particular accessory 7 shown in FIG. 1 is merely representative of a variety of different components that can be utilized to efficiently store work related items such as papers, books, binders and other office supplies as will be explained in detail hereinafter.

The panel system 3 may be of any suitable design. Typically, as shown in FIGS. 1, 2 and 4, the panel system comprises a number of individual vertical panels 8 joined by appropriate connectors 10. Each panel 8 is manufactured with a vertical back member 9 covered with an attractive fabric 11. Frames 13 support the back 9 and also cooperate with the connectors 10 to join adjacent panels 8 to each other. The frames 13 have respective legs 15 that define a number of vertically oriented and aligned slots 17.

Support System

As shown best in FIG. 3, the support system 5 includes five components: a work bar 19, a pair of mounting brackets 21, and a pair of end caps 23. The work bar 19 preferably has a length slightly less than the total width of a panel 8. The work bar has a generally rectangular cross-section, with a front wall 24, back wall 26, bottom wall 29, and sloped top wall 31. The bottom wall 29 extends slightly beyond the back wall 26 and terminates in a lip 33 spaced from the back wall 26 to cooperate therewith to form a lower notch 35. Similarly, the top wall 31 extends beyond the back wall 26 and terminates in a lip 37, which cooperates with the back wall to form an upper notch 39.

The work bar front wall 24 is configured with a longitudinally extending space 40 located near the upper end of the front wall 24. The space 40 opens into a half moon shaped groove 41. The groove 41 is defined by a concave lower surface 43 of an associated wall 44. The concave surface 43 intersects a flat top surface 45 of the wall 44. A short lip 47 depends from the flat surface 45.

The interiors of the work bar walls 24, 26, 29, and 31 are designed with various integral short ridges. The ridges run longitudinally along and cooperate with the respective walls to create interior longitudinal grooves 49, 51, and 53. Depending from the work bar bottom wall is an angled hook 55. The angled hook 55 cooperates with the bottom wall to create a generally triangular shaped open space 73.

The mounting brackets 21 are used to mount a work bar 19 to a panel 8. The mounting brackets are right and left handed, but are otherwise identical. As shown best in FIG. 2, each mounting bracket 21 is generally L-shaped, having a relatively long leg 25 and a relatively short leg 27. And as shown in FIG. 3, the long leg 25 fits within the notches 35 and 39 of the work bar. The short leg 27 is formed with an upper tooth 57 and an upper notch 59. The short leg is also formed with a lower tooth 61 and a lower notch 63. The teeth 57 and 61 are designed to pass through associated slots 17 in the panel frame 13, with the mounting bracket notches 59 and 63 engaging the panel frame leg 15 so as to removably support the bracket 21 on the frame 13.

As shown in FIGS. 1, 2 and 4, the two end caps 23 are also right and left handed but otherwise identical. Referring to FIG. 2, each end cap has a flat plate 65 with an outline that matches the cross-sectional outline of the work bar 19. Joined to the flat plate 65 are short posts 67. The posts 67 are designed to snugly fit into respective grooves 49, 51, and 53 of the work bar, thereby retaining the end caps to cover the ends of the work bar.

The lower end of each end cap 23 has a line 69 (FIG. 1) of decreased thickness. If desired, the end cap can be broken along the line 69, with the small generally triangular break away piece 71 being discarded. As a result, the open space 73 (FIG. 3) between the work bar bottom wall 29 and the angled hook 55 is uncovered. In that manner, electrical wires 74 can be laid in the spaces 73 and supported by the angled hooks 55 of adjacent work bars to provide a neat and convenient wire run along the upright panels 8.

The work bar 19, mounting brackets 21, and end caps 23 may be made from any suitable material. However, it is preferred that the work bar be made from an aluminum extrusion, such as type 6063-T5. The preferred material for the mounting brackets is 16 gauge hot rolled steel. The end caps are preferably made from a tough thermosetting plastic material.

Mounting Clip

To suspend the various accessories 7 from the work bar 19, the present invention further comprises a mounting clip 75, FIG. 5. In the illustrated construction, the mounting clip 75 is comprised of a relatively thin band 77. The band 77 may be arcuate in shape and subtend an angle slightly less than 180°. One end of the band 77 joins, by means of a gradual reverse bend 79, a deep U-shaped hem 81. Preferably, the free end 83 of the hem 81 is approximately in line with the mounting clip reverse bend 79.

The band 77 is designed to fit within the half moon groove 41 of the work bar 19 described previously. Specifically, the mounting clip band convex surface 85 nests on the work bar groove concave surface 43. The free end 87 of the mounting clip band 77 is adjacent the work bar groove flat surface 45 and the hem 81 lies outside the work bar groove 41 when the band is properly nested on the work bar concave surface.

The mounting clip 75 preferably has a length approximately equal to the width of the accessory 7 with which it will be used. The mounting clip may be 20 gauge cold rolled steel that is rolled to the desired configuration.

Accessories in General

Figure 10:
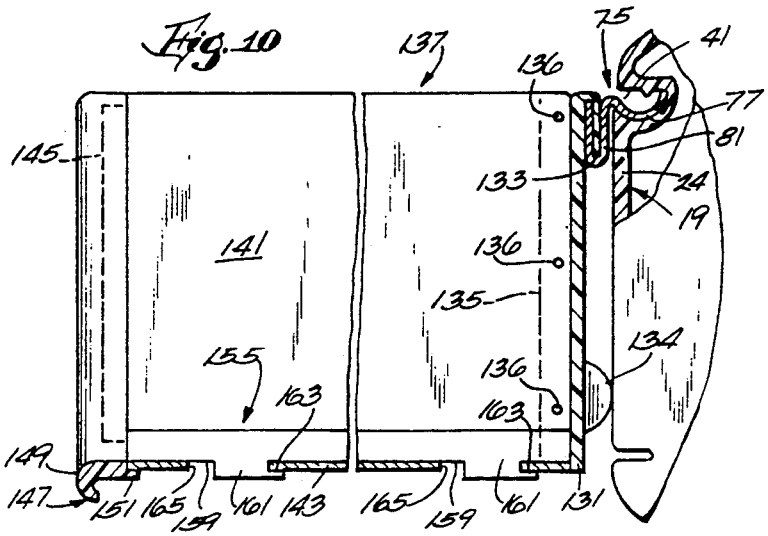
FIG. 10 is a cross-sectional view of the apparatus shown FIG. 9 taken generally along line 10—10.
Figure 12:
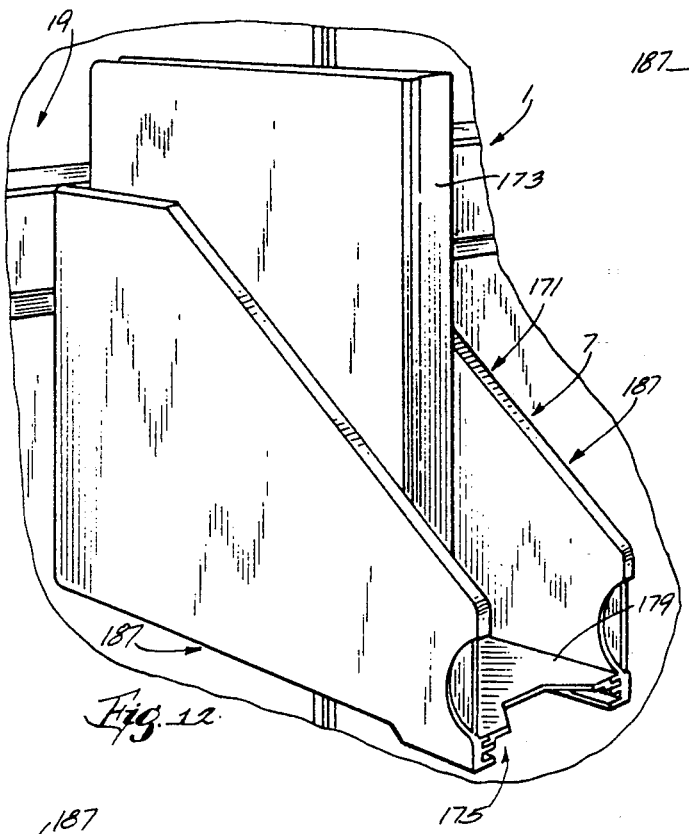
FIG. 12 is a perspective view of a binder bin accessory from the support system of the present invention.
Figure 15:
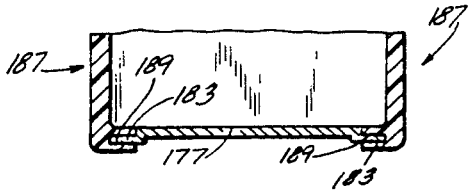
FIG. 15 is a cross-sectional view of the accessory bin shown in FIG. 14 taken generally along line 15—15.
Figure 14:
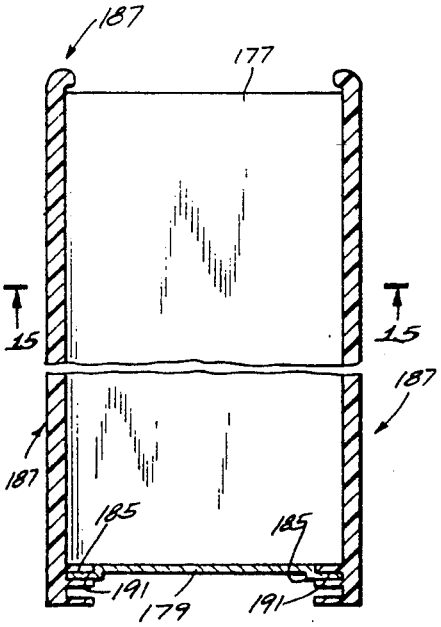
FIG. 14 is a cross-sectional view of the accessory shown in FIG. 13 taken along line 14—14.
Figure 13:
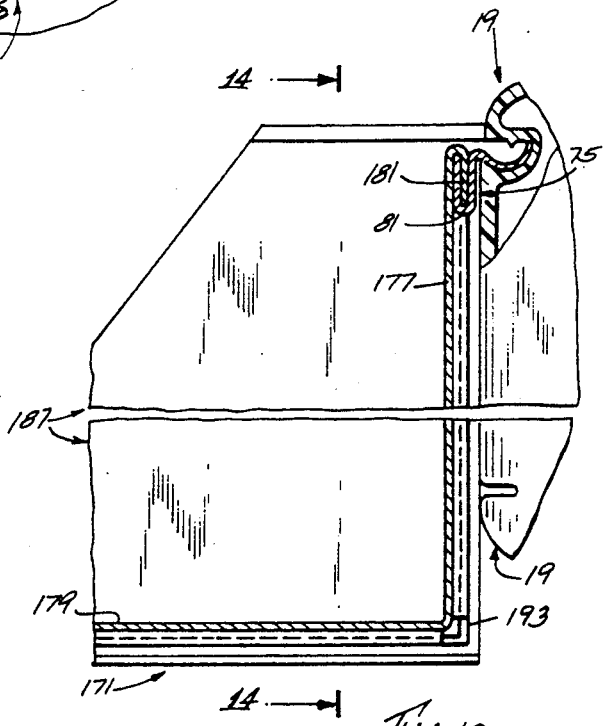
FIG. 13 is a vertical cross-sectional view of the accessory and support system shown in FIG. 12.

As shown in FIGS. 5, 10 and 13, the invention calls for a family of accessories 7, each having a back which is bent over into a deep hem, as will be more particularly described below. The hem of the back is snugly insertable into the hem 81 of the mounting clip 75. Then, to suspend the accessory 7 from the work bar 19, the mounting clip 75 is aligned with the space 40 of the work bar. The accessory 7 and associated mounting clip 75 are tilted clockwise with respect to FIGS. 5, 10 and 13 such that the mounting clip free end 87 can enter the work bar space 40. The amount of tilt is at least approximately 35°. Then the mounting clip free end 87 is slid into the half moon groove 41 while simultaneously rotating the accessory 7 in the counterclockwise direction with respect to FIGS. 5, 10 and 13, until the mounting clip band 77 lies entirely within the half moon groove and nests on the work bar concave surface 43, and the lower portions of the accessory rest against the work bar front wall 24 (FIG. 3). The lip 47 in the work bar half moon groove prevents the mounting clip 75 from coming out of the groove 41 unless the accessory 7 is simultaneously lifted, tilted clockwise with respect to FIGS. 5, 10 and 13, and pulled away from the work bar groove. Hence the accessory 7 can be accidentally bumped from any direction without dislodging the mounting clip 75 from the work bar groove 41.

Letter Tray

More particularly, one of the accessories 7 that is advantageously used with the support system 5 is a letter tray 89, shown at FIGS. 1 and 5 through 7. The letter tray 89 has a tray 90 composed of an integral floor 91 and back 93 that are preferably made from 20 gauge sheet steel. The longer dimension of the tray 90 may be either letter or legal size. As indicated generally above, the upper end of the back 93 is bent over into a deep hem 95. The hem 95 of the tray back is snugly insertable into the hem 81 of the mounting clip 75, and the tray 90 is mounted to the work bar 19 by inserting the hem 95 of the tray into the hem of the mounting clip. The opposite ends of the tray floor 91 and back 93 are formed with respective steps 97 and 99 that are parallel to and noncoplanar with the floor and back.

The letter tray 89 further comprises opposed symmetrical side walls 101 that are snugly assembled to the tray 90. The side walls 101 are preferably molded from an acrylonitrile butadiene styrene (ABS) plastic material. The same side walls are used for both letter and legal size trays. Each side wall comprises a flat panel 103 with a short bottom wall 105 perpendicular thereto. The bottom wall 105 has a rather deep notch 107 that receives a step 97 of the tray floor 91. The bottom wall 105 has a flat end 109 above the notch 107 that abuts the short right angle leg 111 between the tray floor 91 and the associated step 97. Depending from the bottom wall 105 below the notch 107 is a hook 115 such that a space 117 is formed between the hook 115 and the bottom wall.

Each side wall 101 further comprises a back wall 119 that is generally similar to the bottom wall 105. The back wall 119 has a notch 121 that receives a step 99 of the tray back 93. End surface 123 of the back wall 119 abuts the short right angle leg 125 between the tray back 93 and the associated step 99.

Extending along the top edge of each side wall 101 is a right angle tab 127. The tab 127 is designed with a contour that can slidingly fit within the space 117 of another side wall.

The letter tray 89 is assembled by pushing respective side walls 101 onto the opposite ends of the tray 90, with the side wall notches 107 snugly receiving the tray floor steps 97 and the side wall notches 121 snugly receiving the tray back steps 99. In the assembled condition, the back end 128 of the side wall extends backwardly beyond the tray back 93 and steps 99. Then the hem 81 of the mounting clip 75 is inserted into the hem 95 of the tray back 93.

The letter tray 89 is then suspended from the work bar 19 in the manner described generally above. Particularly, the mounting clip 75 is aligned with the space 40 of the work bar. The letter tray 89 and associated mounting clip 75 are tilted clockwise with respect to FIG. 5 such that the mounting clip free end 87 can enter the work bar space 40. Then the mounting clip free end 87 is pushed into the half moon groove 41 while simultaneously rotating the letter tray in the counterclockwise direction with respect to FIG. 5 until the mounting clip band 77 lies entirely within the half moon groove and nests on the work bar concave surface 43 and the lower portions of the side wall back ends 128 rest against the work bar front wall 24 (FIG. 3).

Letter Trays Stackable

It is a feature of the present invention that several letter trays 89 are stackable upon each other. For that purpose, the tabs of a first letter tray, such as tab 127 of a tray 89' of FIG. 6, are slid into the corresponding spaces 117 of a second letter tray. A pair of cooperating detents may be formed on the tabs 127 and the hooks 115 for cooperating with each other to prevent accidental disengagement of the two letter trays.

The stack of letter trays may be suspended from a work bar 19. The letter trays may be stacked both on top of and under the particular mounted letter tray 89 shown in FIG. 6. If additional letter trays are stacked on top of the mounted letter tray 89, the additional trays must be slid onto the mounted letter tray before mounting to the work bar 19.

The mounting clip 75, prior to being attached to the mounted letter tray 89, is then installed in the space 40 of the work bar 19 generally in the manner described above. That is, the mounting clip 75 is tilted clockwise with respect to FIG. 5 such that the mounting clip free end 87 can enter the work bar space 40. Then the mounting clip free end 87 is pushed into the half moon groove 41 while simultaneously rotating the mounting clip 75 in the counterclockwise direction with respect to FIG. 5 until the mounting clip band 77 lies entirely within the half moon groove and nests on the work bar concave surface 43.

After the mounting clip 75 is thus installed to the work bar 19, the mounted letter tray 89 is installed to the mounting clip by inserting the hem 95 of the tray back 93 into the mounting clip hem 81, as indicated above.

Slanted Storage Tray

Turning to FIGS. 8 through 11, an accessory 7 in the form of a slanted storage tray 129 is depicted. The slanted storage tray 129 conveniently separates and stores selected items such as envelopes, papers and letters 130. The slanted storage tray 129 is suspended from the work bar 19 by a mounting clip 75. For that purpose, the slanted storage tray comprises a trapezoidal back 131 with a top end that is bent over to form a hem 133. As indicated above, the back hem 133 is insertable into the hem 81 of a mounting clip 75. One or more dimples 134 are formed on the back 131.

Both ends of the back 131 have bent over wings 135. Attached to, as by fasteners 136, and extending from the wings 135 is a multiple segment bottom 137. In the particular slanted storage tray 129 shown, the bottom 137 is segmented to contain 3 generally V-shaped pockets 139, but more or fewer pockets may be formed in the bottom. Each pocket 139 is defined by two sloped sides 141 that converge to a narrow floor section 143. The free end of each side 141 is formed with a rather long step 145 that is parallel to and non-coplanar with the side 141.

Pressed over the free end of the pocket bottom 137 is a decorative front trim 147. The trim 14 has an outline that generally matches that of the bottom. That is, the trim 147 has sections that correspond to the bottom sloped sides 141 and floor sections 143. The trim has a curved hook-like portion 149 that presents a finished and pleasing appearance. The trim side 151 opposite the hooked portion 149 at the bottom floor section 143 abuts the floor section free end. The trim sides 153 corresponding to the bottom sides 141 are formed with respective rather deep notches 148 that snugly receive the steps 145 of the sloped sides 141. Thus, the trim is held in place on the bottom 137 by the engagement between the trim notches 148 and the bottom steps 145.

In the preferred embodiment, the slanted storage tray 129 further comprises a divider 155 in association with each pocket 139. Each divider 155 is manufactured as a thin generally rectangular plate 157. The lower edge 159 of the plate 157 has a pair of tabs 161 (FIG. 10) projecting therefrom. The plate lower edge 159 and each tab 161 cooperate to define a respective notch 163. The tabs 161 are designed to fit within respective slots 165 in each floor section 143 of the bottom 137. With the divider tabs 161 within the respective bottom slots 165, the divider lower edge 159 is slidable along the bottom floor section 143 such that the divider notches 163 engage the bottom floor section 143, thereby retaining the divider to the bottom. To provide a neat appearance to the slanted storage tray 129, each divider plate 157 may be cut out, as at reference numeral 167, along its front edge. In addition, a series of bumps 169 on the divider plate 157 provide an area for grasping the divider that presents a pleasing touch without leaving fingerprints.

The various components of the slanted storage tray 129 are manufactured from different materials. Preferably, the bottom 137 is made from 24 gauge cold rolled steel that is bent to the desired configuration. The back 131 is also made from 24 gauge cold rolled steel. The trim 147 and the divider 155 are preferably made from ABS plastic formulated to meet Underwriter's Laboratory Specification 941-B.

The slanted storage tray 129 is suspended from the work bar 19 in a manner substantially similar to the suspension of the letter tray 89 described previously. That is, the hem 133 of the slanted storage tray back 131 is inserted into the hem 81 of a mounting clip 75. The slanted storage tray is tilted clockwise with respect to FIG. 10, and the band 77 of the mounting clip is partially inserted to the half moon groove 41 of the work bar 19. Then the slanted storage tray is tilted counterclockwise with respect to FIG. 10 and the mounting clip band 77 is pushed into the work bar groove 41 until the back 131 is approximately vertical and the dimples 134 contact the work bar front wall 24.

Binder Bin

Referring now to FIGS. 12 through 15, the paper management apparatus 1 is illustrated as including an accessory 7 in the form of a binder bin 171. The binder bin 171 is ideal for holding stiff covered three ring binders and the like 173 in an upright position.

The binder bin 171 is made of a tray 175 that includes an integral back 177 and floor 179. The top end of the back 177 is bent over to create a U-shaped hem 181. The hem 181 of the binder bin back fits within the hem 81 of a mounting clip 75. The tray back has steps 183 along both ends, and the tray floor has similar steps 185.

Right and left handed side walls 187 complete the binder bin 171. Each side wall 187 has a vertical notch 189 for snugly receiving an associated step 183 of the tray back 177. Each side wall further has a horizontal notch 191 for receiving the associated step 185 of the tray floor 179. In that manner, the side walls and tray 175 are assembled together to form the attractive and versatile binder bin 171. The back ends 193 of the side walls project rearwardly from the tray back 177 when the side walls are assembled to the tray 175.

The tray 175 is preferably made of 20 gauge sheet steel, and the side walls 187 are preferably made of ABS plastic, as described previously in connection with the letter tray 89 of FIGS. 5 through 7.

The suspension of the binder bin 171 from the work bar 19 by means of the mounting clip 75 is also as previously described. That is, the hem 181 of the binder bin back 177 is inserted snugly into the hem 81 of a mounting clip 75. The binder bin 171 is tilted clockwise with respect to FIG. 13, and the band 77 of the mounting clip 75 is partially inserted to the half moon groove 41 of the work bar 19. Then the binder bin 171 is tilted counterclockwise with respect to FIG. 13 and the mounting clip band 77 is pushed into the work bar groove 41 until the back 171 is approximately vertical and contacts the work bar front wall 24.

As herein described, the letter tray 89, slanted storage tray 129, and binder bin 171 comprise a family of accessories 7 that are interchangeable with a common support system 5. Further, the accessories are designed in a manner that allows maximum flexibility in their sizes Such flexibility is achieved by changing the length of the steel trays 90 and 175 of the letter tray 89 and binder bin 171, respectively, while using the same corresponding side walls 101 and 187. Different backs 131, bottoms 137, and trims 147 of the slanted storage tray 129 are also available to provide different numbers of pockets 139 and dividers 155. Additional flexibility is made possible by the slidable nature of the mounting clips 75 within the work bar half moon groove 41. After an accessory 7 is suspended from the work bar 19, the accessory can easily be moved along the work bar to a different location without having to remove the accessory from the work bar.

Thus, it is apparent that there has been provided, in accordance with the invention, paper management apparatus that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. Paper management apparatus comprising:

a. frame means defining a plurality of spaced slots;

b. bracket means for removably engaging selected slots of the frame means;

c. a work bar defining notches for receiving the bracket means to be supported thereby on the frame means and an elongated groove having a generally half moon shape with a concave lower surface and a flat upper surface that intersects the lower surface;

d. a mounting clip comprising:

1) a band having a contour that nests on the work bar half moon groove concave surface and a free end that abuts the half moon groove flat surface to retain the mounting clip within the work bar half moon groove, and 2) a hem joined to the band and lying outside of the work bar half moon groove; and e. accessory means for holding selected paper items and for inserting into the mounting clip hem to thereby be suspended from the work bar.

2. The paper management apparatus of claim 1 wherein the work bar further defines a lip depending from the flat surface of the half moon groove and extending into the half moon groove, the lip cooperating with the mounting clip free end to prevent unintentional removal of the mounting clip from the work bar half moon groove.

3. The paper management apparatus of claim 1 wherein the accessory means comprises a letter tray including:

a tray having an integral floor and back at generally right angles to each other, the back including the hem that is inserted into the hem of the mounting clip, the tray having opposite ends; and a pair of side walls having respective upper and lower edges and being assembled on the respective opposite ends of the tray.

4. The paper management apparatus of claim 3 wherein:

the upper edge of each side wall includes a tab having a predetermined exterior contour; and the lower edge of each side wall includes a hook defining an interior contour that is substantially identical to the tab exterior contour, so that the side wall tabs of a first letter tray can be slid into the side wall hooks of a second letter tray to thereby enable the letter trays to be stackably suspended.

5. The paper management apparatus of claim 3 wherein:

the opposite ends of the tray back and floor include respective steps that are generally parallel to and non-coplanar with the back and floor; and each side wall includes notches that snugly receive associates tray back and floor steps, so that the letter tray is assembled by inserting the tray steps into the associated side wall notches.

6. The paper management apparatus of claim 1 wherein the accessory means comprises:

a back having an upper end having a hem that is inserted into the hem of the mounting clip;

a bottom having a first end fastened to the back and a free end and extending at generally right angles to the back, the bottom forming at least two sides defining a generally V-shaped pocket;

a decorative trim assembled to the bottom free end; and a divider associated with the bottom pocket, the divider having tab means for cooperating with the bottom to removably retain the divider in the bottom pocket.

7. The paper management apparatus of claim 6 wherein:

the free end of the bottom includes steps that are parallel to and non-coplanar with the respective sides; and the decorative trim includes notches to snugly receive associated bottom steps, so that the decorative trim is assembled to the bottom by inserting the bottom steps into the decorative trim notches.

8. Apparatus for managing paper comprising:

an elongated work bar having opposed ends, a bottom wall, and a front wall that defines a generally half moon groove having a concave surface;

bracket means for mounting the work bar to a selected member;

a mounting clip having a band portion that is removably receivable within the work bar half moon groove and a hem that extends out of the work bar half moon groove; and accessory means for holding selected papers and the like, the accessory means being inserted in the mounting clip hem for being removably suspended thereby from the work bar.

9. The apparatus of claim 8 wherein the work bar half moon groove is defined by a concave lower surface and a flat upper surface that intersects the concave lower surface.

10. The apparatus of claim 9 wherein a short lip depends from the work bar flat upper surface into the half moon groove.

11. The apparatus of claim 9 wherein the mounting clip band portion has a convex surface that removably nests on the work bar half moon groove concave surface and a free end that cooperates with the half moon groove lip to retain the band portion within the half moon groove against accidental bumping.

12. The apparatus of claim 8 wherein the accessory means comprises:

a tray having a back with a hem insertable into the hem of the mounting clip and a floor, the back and floor having opposite ends with respective steps formed thereon; and a pair of side walls having respective top and bottom edges and notches that snugly receive the steps on the opposite ends of the tray to thereby form a four-sided letter tray.

13. The apparatus of claim 8 wherein the accessory means comprises:

a back having a hem insertable into the hem of the mounting clip;

a bottom having a first end attached to the back and extending generally perpendicular thereto and having a free end, the bottom including a plurality of sides that define at least one generally V-shaped pocket having a floor section;

trim means for assembling over the free end of the bottom; and a divider associated with the bottom pocket and having tab means for removably engaging the divider with the pocket floor section.

14. The apparatus of claim 8:

wherein the work bar includes a hook depending from the bottom wall thereof and cooperating therewith to define an open space; and further comprising an end cap fittable over at least one work bar end, the end cap having a breakaway piece that covers the work bar open space, the breakaway piece being selectively removable from the end cap to expose the work bar open space, so that electrical wires and the like can be laid on and pass out of the work bar hook and past the end cap.

15. The apparatus of claim 12 wherein the bottom edge of each side wall is formed with a hook having a predetermined interior contour, and wherein the top edge of each side wall is formed with a tab having an exterior contour that is slidable within the hook contour of another side wall to thereby enable a first letter tray to be stacked on a second letter tray by sliding the hooks of the side walls of the first letter tray over the tabs of the side walls of the second letter tray.

16. Apparatus useful for paper management comprising a work bar having elongated front, back, top, and bottom walls configured to form a generally hollow four-sided structure having opposed ends, the work bar front wall including an elongated space opening into a half moon shaped groove defined by a concave lower surface and a flat upper surface that intersects the concave surface.

17. The apparatus of claim 16 wherein the flat upper surface of the work bar half moon groove includes a short lip depending therefrom and projecting into the half moon groove.

18. The apparatus of claim 16 wherein the work bar further comprises a hook depending from the bottom wall and cooperating therewith to form an open space therebetween for holding electrical wires and the like.

19. The apparatus of claim 18 further comprising at least one end cap snugly fittable into and covering a selected end of the work bar, the end cap having a breakaway piece alignable with the work bar open space, the breakaway piece being selectively breakable from the end cap to thereby expose the work bar open space and enable electrical wires and the like to pass out of the work bar.

20. A mounting clip comprising:

a. a band portion having a convex surface and a free end and a second end;

b. a generally U-shaped hem having a free end and a second end and having a convex surface; and c. a curved portion joining the second end of the band portion to the second end of the hem, the curved portion having a concave surface that joins the respective convex surfaces of the band portion and the hem to thereby form a reverse bend between the band portion and the hem.

21. Paper management apparatus comprising:

a back having upper and lower ends and opposed side ends;

a generally U-shaped back hem joined to the back upper end;

a floor joined to the back lower end and extending generally perpendicular therefrom and having opposite ends generally coplanar with the respective back side ends;

first and second side walls having respective top and bottom edges and being assembled to the respective side ends of the back and floor to cooperate therewith to form a four-sided letter tray for holding papers and the like; and a mounting clip, having a clip hem engageable with said back hem, and having means for connecting to a support.

22. Paper management apparatus comprising:

a back having upper and lower ends and opposed side ends;

a generally U-shaped hem joined to the back upper end;

a floor joined to the back lower end and extending generally perpendicular therefrom and having opposite ends generally coplanar with the respective back side ends; and first and second side walls having respective top and bottom edges and being assembled to the respective side ends of the back and floor to cooperate therewith to form a four-sided letter tray for holding papers and the like;

wherein each side wall bottom edge has a hook extending therefrom with a predetermined interior contour; and each side wall top edge has a tab extending therefrom with an exterior contour that is slidable within the hook of another side wall, so that the tabs of the side walls of a first letter tray can be slide within the hooks of the corresponding side walls of a second letter tray to thereby enable stacking the second letter tray on the first letter tray.

23. Paper management apparatus comprising:

a back having upper and lower ends and opposed side ends;

a generally U-shaped hem joined to the back upper end;

a floor joined to the back lower end and extending generally perpendicular therefrom and having opposite ends generally coplanar with the respective back side ends; and first and second side walls having respective top and bottom edges and being assembled to the respective side ends of the back and floor to cooperate therewith to form a four-sided letter tray for holding papers and the like wherein the opposite side ends of the back and floor includes steps parallel to and non-coplanar with the respective back and floor; and the first and second side walls include respective notches that snugly receive the corresponding steps of the back and floor to thereby enable the letter tray to be assembled by inserting the back and bottom steps into the associated side walls notches.

24. Paper management apparatus comprising:

a back;

a generally U-shaped hem joined to the back;

a bottom having a first end joined to the back and a free end, the bottom defining at least one generally V-shaped pocket;

trim means assemblable to the bottom free end for providing a decorative cover to the bottom free end; and a divider removably engaged in the bottom pocket and extending out of the pocket to aid in retaining paper and the like within the pocket.

25. The paper management apparatus of claim 24 wherein:

the bottom includes at least one pair of sides defining the V-shaped pocket, the sides having respective first ends attached to the back and respective free ends, each side free end including a step that is parallel to and non-coplanar with the side; and the trim means defines notch means for snugly receiving the steps of the sides to thereby enable the trim means to be assembled to the bottom by inserting the steps of the bottom into the notch means of the trim means.

26. A method of suspending a paper management accessory from a vertical panel and the like comprising the steps of:

providing a work bar having a half moon shaped groove, a selected paper management accessory having a back end with a hem, and a mounting clip having a hem and a convex band with a free end;

inserting the hem of the mounting clip into the hem of the paper management accessory;

rotating the paper management accessory in a first direction to separate the paper management accessory back end from the work bar;

inserting the free end of the mounting clip band into the work bar half moon shaped-groove; and rotating the paper management accessory in a second direction opposite the first direction and simultaneously pushing the mounting clip band free end into the work bar half moon groove until the mounting clip band nests within the work bar half moon groove and the paper management accessory back end rests against the work bar.

27. A method as recited in claim 26 wherein the rotation of the paper management accessory in each instance is at least approximately 35°.

28. A method of stacking letter trays comprising the steps of:

providing first and second letter trays, each tray having first and second side walls with respective upper edges that define tabs with a predetermined contour and respective lower edges that define hooks with the predetermined contour; and sliding the tabs of the first letter tray into the hooks of the second letter tray to thereby stack the second letter tray on the first letter tray.

29. A method of suspending a paper management accessory from a vertical panel and the like comprising the steps of:

providing a work bar having a half moon shaped groove, a selected paper management accessory having a back end with a hem, and a mounting clip having a hem and a convex band with a free end;

rotating the mounting clip in a first direction, thereby aligning the free end of the mounting clip with the half moon shaped groove;

inserting the free end of the mounting clip band into the work bar half moon shaped groove;

rotating the mounting clip in a second direction opposite the first direction and simultaneously pushing the mounting clip band free end into the work bar half moon groove until the mounting clip band nests within the work bar half moon groove; and inserting the hem of the paper management accessory into the hem of the mounting clip.

30. A method of suspending a plurality of letter trays from a vertical panel and the like comprising the steps of:

providing a work bar having a half moon shaped groove, and a mounting clip having a hem and a convex band with a free end;

providing first and second letter trays, each tray having first and second side walls with respective upper edges that define tabs with a predetermined contour and respective lower edges that define hooks with the predetermined contour, and having a back end with a hem;

sliding the tabs of the first letter tray into the hooks of the second letter tray to thereby stack the second letter tray on the first letter tray;

rotating the mounting clip in a first direction, thereby aligning the free end of the mounting clip with the half moon shaped groove;

inserting the free end of the mounting clip band into the work bar half moon shaped groove;

rotating the mounting clip in a second direction opposite the first direction and simultaneously pushing the mounting clip band free end into the work bar half moon groove until the mounting clip band nests within the work bar half moon groove; and inserting the hem of one of the letter trays into the hem of the mounting clip.

31. Paper management apparatus comprising:

a. a work bar having an elongated groove;

b. a mounting clip comprising:

1) a band having a contour by which it is capable of mating with said groove and a free end to retain said mounting clip within said groove, and 2) a mounting clip hem joined to said band and lying outside of said groove; and c. accessory means for holding selected items, having a hem engagable with said mounting clip hem to thereby be suspended from said work bar.

32. The paper management apparatus of claim 31 wherein said work bar further defines a lip disposed within said groove, said lip cooperating with said mounting clip free end to prevent inadvertent removal of said mounting clip from said groove.

* * * * *